US005865482A

United States Patent [19]

Aoki

[11] Patent Number: 5,865,482

[45] Date of Patent: Feb. 2, 1999

[54] MAGNETIC LOCK DEVICE

[75] Inventor: Yoshihiro Aoki, Tokyo, Japan

[73] Assignee: Application Art Laboratories Co., Ltd., Tokyo, Japan

[21] Appl. No.: 347,141

[22] Filed: Nov. 23, 1994

[51] Int. Cl.[6] ..... F05C 17/56

[52] U.S. Cl. ..... 292/251.5; 292/DIG. 50; 24/303

[58] Field of Search ..... 292/251.5, DIG. 50; 24/303

[56] References Cited

U.S. PATENT DOCUMENTS

| | | | |
|---|---|---|---|
| 3,324,521 | 6/1967 | Humiston | 24/303 |
| 4,458,395 | 7/1984 | Aoki | 292/251.5 X |
| 4,458,396 | 7/1984 | Aoki | 292/251.5 X |
| 4,736,494 | 4/1988 | Marchesi | 292/251.5 X |
| 4,779,314 | 10/1988 | Aoki | 24/303 |
| 4,941,235 | 7/1990 | Aoki | 24/303 |
| 5,042,116 | 8/1991 | Ossiani | 292/251.5 X |
| 5,152,035 | 10/1992 | Morita | 24/303 |
| 5,208,951 | 5/1993 | Aoki | 24/303 |
| 5,249,338 | 10/1993 | Aoki | 24/303 |
| 5,274,889 | 1/1994 | Morita | 292/251.5 X |
| 5,377,392 | 1/1995 | Morita | 24/303 |
| 5,451,082 | 9/1995 | Murai | 292/DIG. 50 X |
| 5,473,799 | 12/1995 | Aoki | 292/251.5 X |

*Primary Examiner*—Darnell M. Boucher
*Attorney, Agent, or Firm*—Wenderoth, Lind & Ponack, L.L.P.

[57] ABSTRACT

A magnetic lock device easily can be fastened to a fastening member on an object or article such as the flap of a handbag, thereby saving labor costs incurred in fastening the device to the object. Also, any thickened portion that may occur on a fastening member when the device is fastened to the object can be minimized. The magnetic lock device includes a first element incorporating a permanent magnet that acts as a magnetically attracting part and a second element that acts as a magnetically attracted part. The second element includes an attachment having pointed lugs shaped like saw teeth. A receiver having a curled edge formed as an arc in cross section inside and around a peripheral margin of a fastening side receives the pointed lugs extending through the fastening member.

20 Claims, 8 Drawing Sheets

FIG. 10a PRIOR ART
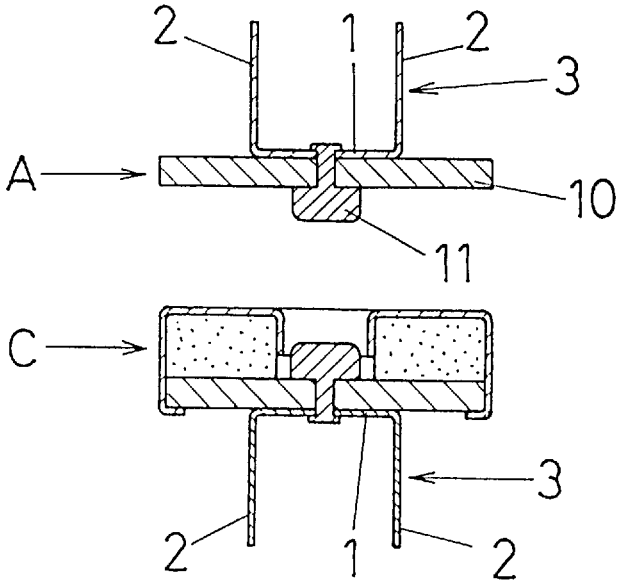
FIG. 10b PRIOR ART
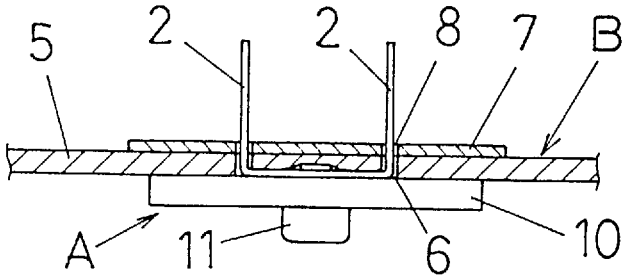
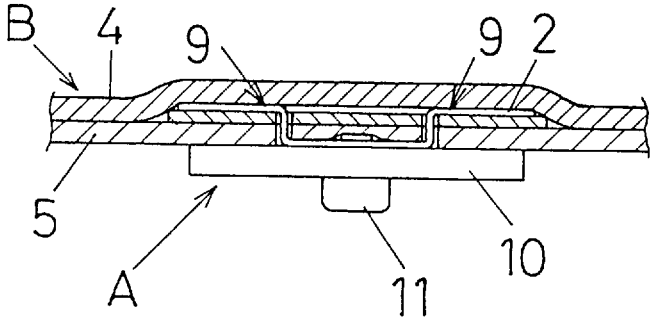
FIG. 10c PRIOR ART

MAGNETIC LOCK DEVICE

BACKGROUND OF THE INVENTION

1. Field of the Invention

The present invention relates to a magnetic lock device that comprises a first element incorporating therein a permanent magnet for providing a magnetic attraction and a second element adapted to be attracted magnetically toward the first element and thereby detachably attached thereto.

2. Prior Art

A conventional magnetic lock device of similar type as disclosed herein is known, and is typically used on articles such as handbags wherein the first element, or the magnetically attracting part, may be mounted to the body of the handbag and the second element, or the magnetically attracted part, may be mounted to the flap of the handbag. More specifically, the first element is located on the outer side of the handbag body, and the second element is located on the inner side of the flap in a position facing the location of the first element. In order to permit the first and second elements to be mounted to the body and flap of the handbag, respectively, each of the elements includes an attachment that is designed to be fastened to a fastening member that is provided on each of the body and flap of the handbag.

Typical examples of such attachment are illustrated in FIGS. 10*a*, 10*b* and 10*c*. As shown, the attachment 3 includes a base plate 1 and a pair of legs 2 extending from the base plate 1. In the conventional magnetic lock device as described above, the first and second elements may be attached to the two parts of an article, such as the body and flap of the handbag, by fastening the respective attachments 3 to corresponding fastening members. Each fastening member has a pair of through holes for receiving the respective legs 2. In this case, the pair of holes must previously be provided on each fastening member, and the attachments 3 must then be fastened to the fastening members by inserting the legs 2 into the holes. This process requires extra fastening steps, making it difficult to reduce labor costs. In addition, the fastening steps are accomplished by inserting the legs 2 of the attachment into the holes in the fastening member, and bending the legs over the fastening member. Thus, an overlap is formed by the bent legs and fastening member. This overlap thickens the fastening member, and damages the aesthetic appearance of the product.

Referring to FIGS. 10*b* and 10*c*, the prior art fastening construction of the second element A, which is the magnetically attracted part which is provided on the flap of the handbag, includes a fastening member B including a front side portion 4 (made of leather) and a rear side portion 5 (also made of leather). The legs 2 of the attachment 3 are inserted through the through holes previously provided in the rear side portion 5, and are further inserted through holes 8 previously provided in a backing washer 7 mounted on the inner side of the rear side portion 5. The portions of the legs 2 that extend from the backing washer 7 are bent, and overlap 9 is formed. This overlap 9 is covered by the front side portion 4. Thus, the front side portion 4 includes a thickened portion formed by the overlap 9. Usually, a hammer or the like is used to strike the thickened portion so that it can be made as thin as possible. Striking the thickened portion would deform the portion of a plate 10 or cylindrical rod 11 on the second element A that is to be contacted and magnetically attracted by first element C. If deformed, the magnetic attraction performance of the first element C would undesirably be degraded. The thickened portion that is formed on the second element A usually appears on the front side of the flap of the handbag. Thus, a solution to this problem is desired.

A similar problem occurs for the first element C. Thus, a hammer or the like us used to strike the thickened portion and may damage the permanent magnet incorporated in the first element C.

SUMMARY OF THE INVENTION

To avoid the above problems, it is the primary object of the present invention to provide a magnetic lock device that simplifies the fastening process, thereby saving labor costs, and reduces any thickened portion that may occur during the fastening process.

In order to achieve the above object, the magnetic lock device according to the present invention includes a first element incorporating a permanent magnet that acts as a magnetically attracting part, and a second element that acts as a magnetically attracted part. The second element includes an attachment that may be embedded within a fastening member on an object and that has extending therefrom pointed lugs shaped like saw teeth. A curled edge having the shape of an arc in cross section is provided around and inside a peripheral marginal edge on a fastening side of the second element. The curled edge is adapted to accept and engage the pointed lugs of the attachment that pass through the fastening member.

In a variation, the arc-shaped curled edge may be between an annular taper formed around the peripheral marginal edge of the magnetically attracted side of the second element and the fastening member.

As another variation, the arc-shaped curled edge may be formed from an additional disk plate attached to the disk plate forming the second element.

The arc-shaped curled edge also may be provided on a fastening side of the first element.

According to the magnetic lock device of the present invention, the pointed lugs shaped like saw teeth on the attachment may become easily deformed along the curled edge when the attachment engages the curled edge. Thus, the attachment can be seated securely within the curled edge. Thereby, the fastening process is simplified and can be accomplished with ease. The outer side of the location where the attachment is fastened to the fastening member contains only the attachment, and no or little thickened portion appears on the front side of the fastening member.

BRIEF DESCRIPTION OF THE DRAWINGS

The above and other objects, advantages and features of the present invention will become apparent from the detailed description of several preferred embodiments that follows by reference to the accompanying drawings, in which:

FIGS. 4*a*, 4*b* and 4*c* show other preferred embodiments, in which FIG. 4*a* and FIG. 4*b* are sectional views illustrating a second embodiment, and FIG. 4*c* is a sectional view illustrating a third embodiment;

FIGS. 10*a*, 10*b* and 10*c* are sectional views illustrating an attachment for a prior art magnetic lock device.

DETAILED DESCRIPTION OF PREFERRED EMBODIMENTS

Figure 1:
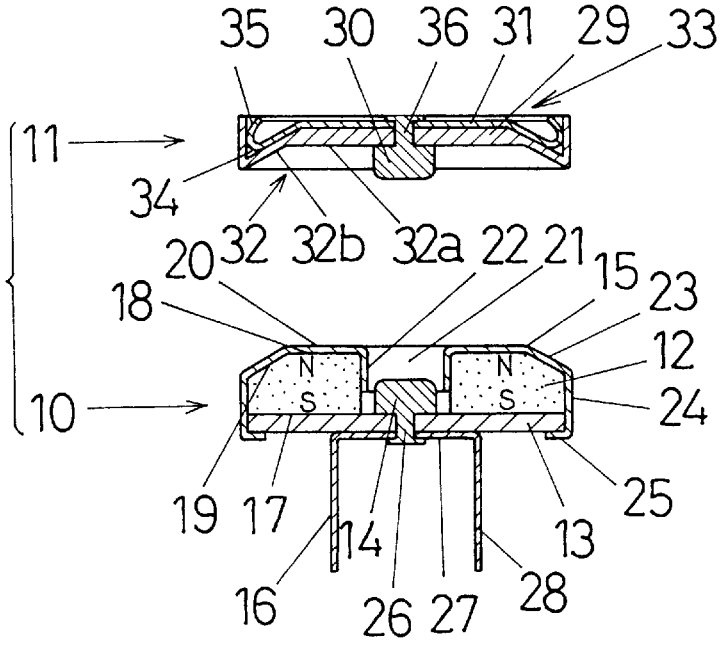
FIG. 1 is a sectional view illustrating a first preferred embodiment of the present invention.

Referring now to the drawings, several preferred embodiments of the present invention are described in full detail.

Referring first to FIG. 1, there is shown a magnetic lock device according to a first preferred embodiment, which comprises a first element 10 that acts as the magnetically attracting part, and a second element 11 that acts as the magnetically attracted part.

The first element 10 includes an annular permanent magnet 12, a first ferromagnetic plate 13, a ferromagnetic rod 14, a nonmagnetic covering 15, and an attachment 16.

The annular permanent magnet 12 is magnetized in the direction of its thickness, and has one side of a first polarity (S polarity as shown) engaged by the first ferromagnetic plate 13, and the opposite side of a second polarity (N polarity as shown) that has its peripheral margin formed as an annular taper 19 becoming less thick toward the outside.

The nonmagnetic covering 15 may be made of any nonmagnetic material such as brass, and has a cylindrical shape closed at the top. Covering 15 thus forms a top plate 20 having a central bore 22 that conforms to the shape of a central bore 21 through the annular permanent magnet 12, and having a peripheral margin formed like a taper 23 that conforms to the shape of the taper 19. Furthermore, the covering 15 includes a lateral wall 24 with a plurality of pawls 25 extending inwardly radially from the bottom of the lateral wall 24 and spaced at regular intervals. Pawls 25 engage the outer edge of the first ferromagnetic plate 13 and are bent under the plate 13. Pawls 25 prevent the first ferromagnetic plate 13 from separating from the permanent magnet 12.

The first ferromagnetic rod 14 may be made of any ferromagnetic material such as iron and has a solid cylindrical shape having a diameter that allows the rod 14 to be placed on the first ferromagnetic plate 13 within the central bore 21 of the permanent magnet 12. Rod 14 has a height one half the height of the central bore 21. The rod 14 includes a shaft 26 that extends through a center bore through the first ferromagnetic plate 13. The shaft 26 engages the attachment 16. This combines the first ferromagnetic rod 14, first ferromagnetic plate 13 and attachment 16 together as a single unit.

The attachment 16 is similar to the prior art attachment, and includes a base plate 27 and a pair of legs 28 extending from the base plate 27. The base plate 27 has a bore through which the shaft 26 may be inserted. The portion of the shaft 26 through the bore may be pressed to combine such parts together.

The second element 11 includes a second ferromagnetic plate 29, a second ferromagnetic rod 30, and a metal disk plate 31 (which may be ferromagnetic or nonmagnetic).

Like the first ferromagnetic plate 13, the second ferromagnetic plate 29 is formed in a disk plate shape from any ferromagnetic material such as iron, and has a magnetically attracted side 32 whose shape conforms to the shape of the top plate 20 of the nonmagnetic covering 15, and which includes a flat surface 32*a* and an annular taper 32*b*. An attaching or fastening side 33 on the top as shown has a recess 34 having a shape analogous to that of the attracted side 32 on the bottom as shown. The recess 34 accommodates the metal disk plate 31.

The metal disk plate 31 includes a curled edge 35 formed to be arc-shaped in cross section around a bottom peripheral edge. The peripheral margin of the recess 34 is formed such that the recess can be deep enough to receive therein the curled edge 35. The second ferromagnetic rod 30 is similar to the first ferromagnetic rod 14, and has a diameter that allows the rod 30 to be inserted into the center bore 22 through the top plate 20 of the nonmagnetic covering 15. The height of rod 30 should be such that the rod 14 can meet the rod 30 when the magnetically attracted side 32 of the second ferromagnetic plate 29 engages the top plate 20 of the nonmagnetic covering 15.

The second ferromagnetic rod 30 also includes a shaft 36 that is inserted through respective center bores in the second ferromagnetic plate 29 and metal disk plate 31. The portion of the shaft 36 extending through the bores may be pressed. This combines all parts together.

Figure 2:
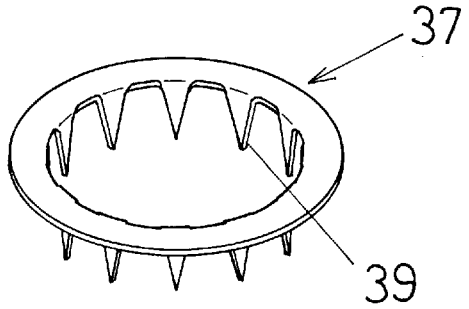
FIG. 2 is a perspective view illustrating an attachment that is provided on a second element for fastening purposes in the first preferred embodiment.
Figure 3:
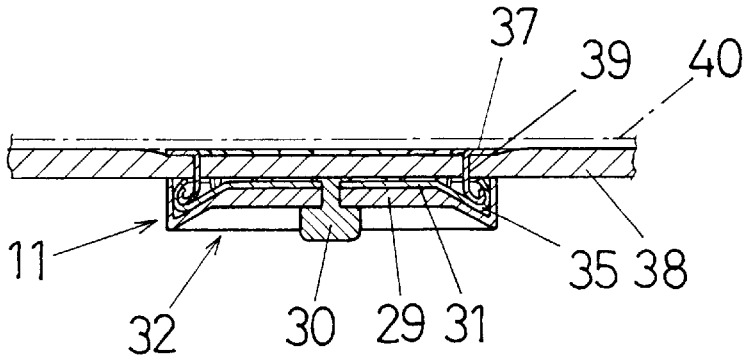
FIG. 3 is a sectional view illustrating how the attachment is fastened on the second element in the first preferred embodiment.

According to the magnetic lock device described above, the first element 10 may be attached to the fastening member (not shown) on an object by way of the attachment as was done in the prior art, while the second element 11 may be attached to a fastening member 38 on the object (such as a handbag flap) as shown in FIG. 3, by way of an attaching device or attachment 37 as shown in FIG. 2.

The attachment 37 is formed from an annular disk plate having a plurality of pointed lugs 39 like saw teeth arranged at regular intervals around an inner peripheral edge and extending from the bottom. The inner diameter of the annular disk plate is substantially equal to the diameter of the curled edge 35 of the metal disk plate 31 on the second element 11.

The attachment 37 may be fastened to the object by the following steps. First, the fastening side 33 of the second element 11 is placed in proper position on the fastening member 38, and the attachment 37 is then applied against the fastening member 38 from the outside. Next, the pointed lugs 39 on the attachment 37 are extended through the fastening member 38, with the tips of the pointed lugs 39 entering into the curled edge 35 of the metal disk plate 31. This causes the tips of the pointed lugs 39 to become deformed along the curled edge 35, thereby engaging the curled edge 35. This completes the fastening operation. It may be understood that there is no need of providing any preliminary steps, such as providing insertion holes on the fastening member 38. Thus, labor costs incurred in such preliminary steps can be saved.

After the fastening operation is completed, the attachment 37 may be covered with the front side portion 40 (usually made of leather) of the object. In this case, the attachment 37 may be embedded in the fastening member 38 in such a way that the former can be accommodated within the thickness of the latter snugly and without protruding from the latter. Thus, no thickened portion will occur on the fastening member.

Figure 4A:
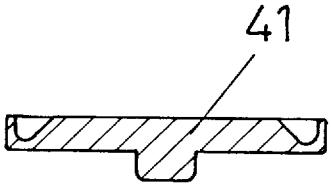
Figure 4B:
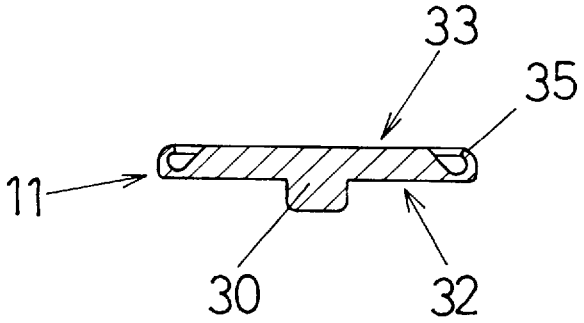
Figure 4C:
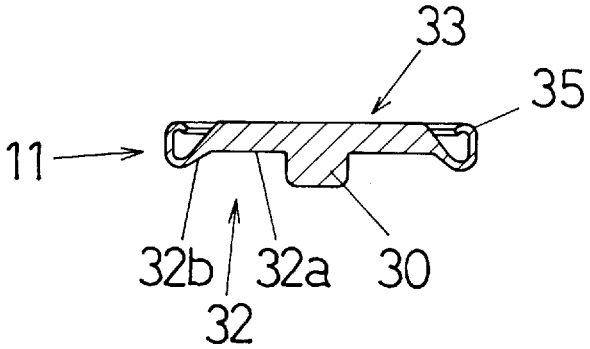

The current embodiment in which the second ferromagnetic plate 29 includes the metal disk plate 31 on which the curled edge 35 is formed may be varied as shown in FIGS. 4*a*, 4*b* and 4*c*. As seen from FIGS. 4*a*, 4*b* and 4*c*, the curled edge 35 may be provided on the second ferromagnetic plate 29 directly without using the metal disk plate 31. The second element 11 shown in FIGS. 4*a* and 4*b* includes the second ferromagnetic plate 29 and second ferromagnetic rod 30 formed integrally. As shown in FIG. 4*a*, the ferromagnetic plate blank 41 may be formed by using a header, and may then be pressed to the shapes that provide the magnetically attracted side 32 and fastening side 33, respectively. Then, a curled edge 35 may be provided on the fastening side 33 inside and around its peripheral margin. As shown in FIG. 4*b*, the magnetically attracted side 32 is flat, so that the magnetically attracting side of the first element 10 may also be flat. This configuration eliminates the annular taper 19 provided on the annular permanent magnet and the taper 23 provided on the nonmagnetic covering 15 in the embodiment of FIGS. 103. As shown in FIG. 4*c*, the embodiment of FIGS. 1–3 further may be varied so that similarly to the embodiment of FIG. 4*b*, the ferromagnetic plate blank of the second element 11 is formed by the header and pressed to provide a configuration that corresponds to that of the first element 10 of the embodiment of FIGS. 103.

Figure 5A:
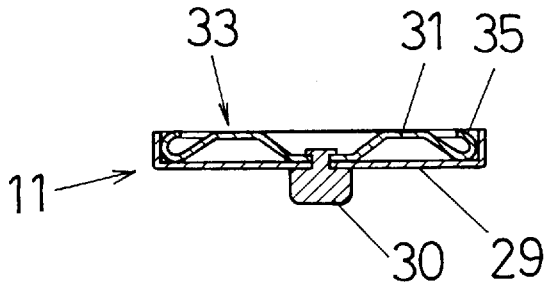
FIGS. 5*a* and 5*b* are sectional views respectively illustrating a fourth embodiment and a fifth embodiment.
Figure 5B:
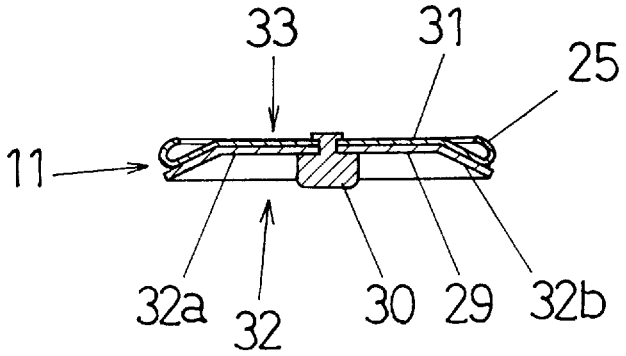

In each of additional variations shown in FIGS. 5*a* and 5*b*, the second ferromagnetic plate 29 may be formed from a ferromagnetic plate blank, and the metal disk plate 31 may also be formed from a ferromagnetic plate blank, which together complete the second element 11.

Figure 6A:
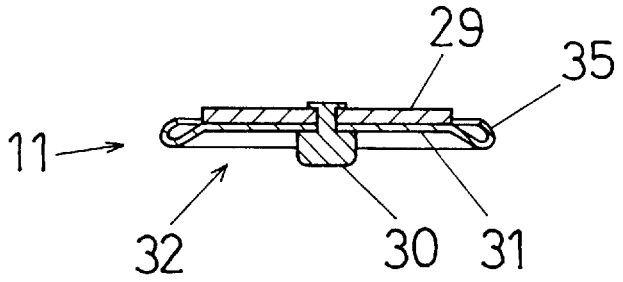
FIGS. 6*a*, 6*b*, 6*c* and 6*d* are similar views respectively illustrating a sixth embodiment, a seventh embodiment, an eighth embodiment, and a ninth embodiment.
Figure 6B:
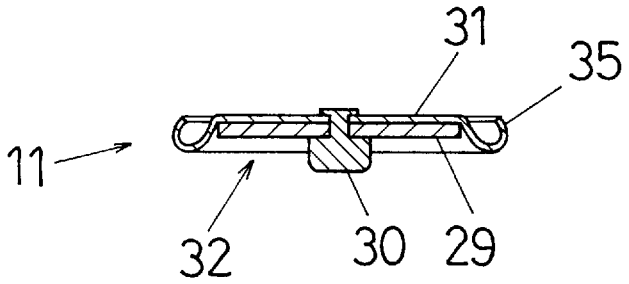
Figure 6C:
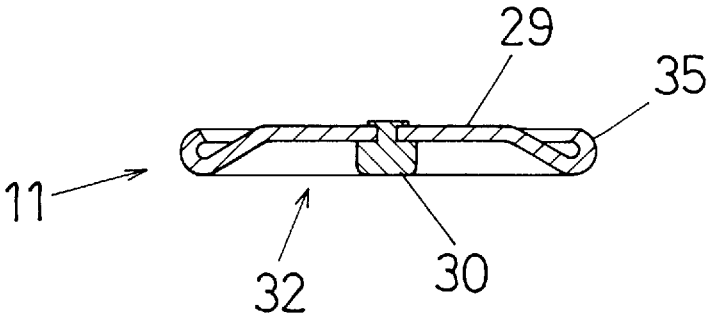
Figure 6D:
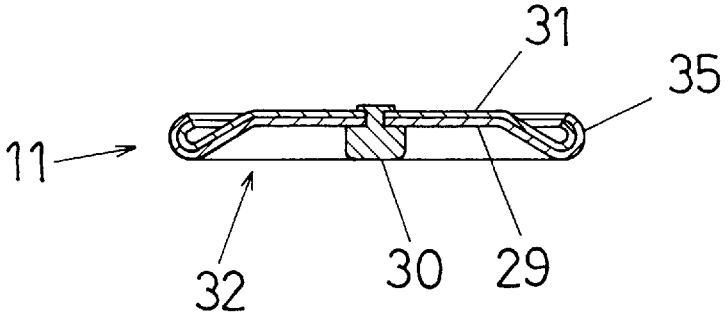

The second element 11 may be formed as shown in FIGS. 6*a*–6*d*. FIGS. 6*a* and 6*b* both show variations of the embodiment of FIG. 1, wherein the second ferromagnetic plate 29 on the second element 11 is diametrically smaller, and a curled edge 35 is provided on the metal disk plate 31 to surround the peripheral edge of the second ferromagnetic plate 29. Specifically, FIG. 6*a* shows that the second ferromagnetic plate 29 is located on the side opposite to the magnetically attracted side 32 at which the metal disk plate 31 is disposed. Therefore, the metal disk plate 31 is made of any ferromagnetic material such as iron. FIG. 6*b* shows that the second ferromagnetic plate 29 is located at the magnetically attracted side 32. In the embodiment shown in FIG. 6*c*, the second ferromagnetic plate 29 includes a curled edge 35 that is formed around the peripheral margin of the plate 29. FIG. 6*d* shows an embodiment in which curled edges are formed around peripheral margins of the overlapped second ferromagnetic plate 29 and metal disk plate 31.

Figure 7:
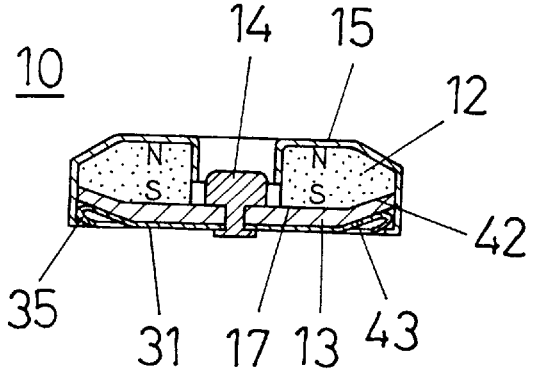
FIG. 7 is a sectional view illustrating attachment on a first element according to a tenth embodiment.

In the embodiment shown in FIG. 7, the first element 10 is constructed such that it may also be fastened to the fastening member by using the attachment 37 shown in FIG. 2. Specifically, an annular taper 42 is formed along the peripheral edge of the first polarity side 17 of the annular permanent magnet 12, and the first ferromagnetic plate 13 also has a shape conforming to the taper 42 on the first polarity side 17. The fastening side of the first element 10 is also tapered as shown by 43. A metal disk plate 31 having a curled edge 35 formed like an arc in cross section and the first ferromagnetic plate 13 are combined together as a unit, and then the curled edge 35 is inserted between the taper 43 and the fastening member (not shown). According to the embodiment of FIG. 7, the first element 10 may also be fastened easily, and any thickened portion that may be produced by the attachment can be reduced.

Figure 8A:
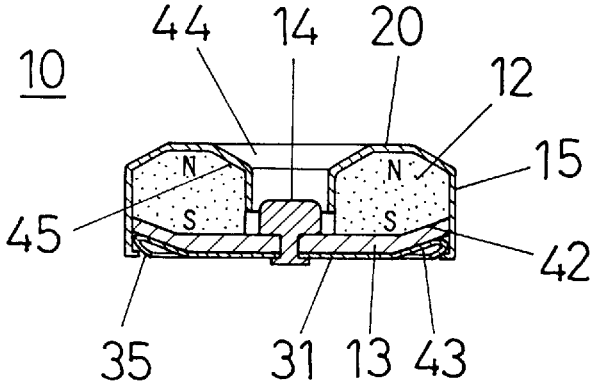
FIGS. 8*a*, 8*b* and 8*c* are sectional views respectively illustrating variations of an eleventh embodiment.
Figure 8B:
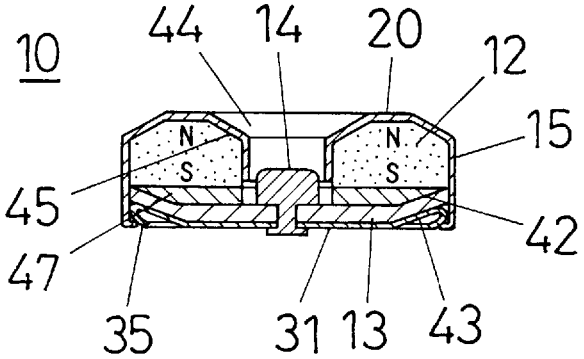
Figure 8C:
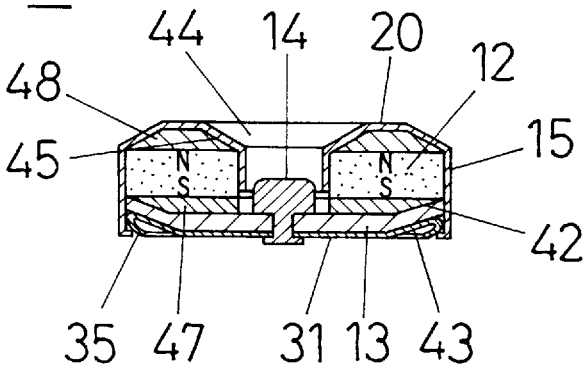
Figure 9:
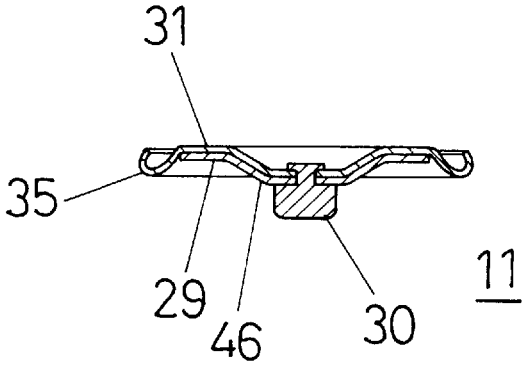
FIG. 9 is a sectional view illustrating the attachment according to the eleventh embodiment used on the second element.

FIGS. 8*a*, 8*b* and 8*c* show variations of the embodiment of FIG. 7, in which the first element 10 includes a funnel-shaped recess 44 that acts as a guide for the second ferromagnetic rod 30 on the second element 11. The funnel-shaped recess 44 includes a funnel-shaped portion 45 outside the center bore 21 in the annular permanent magnet 12, and the top plate 20 of the nonmagnetic covering 15 has a shape confirming to that of the annular permanent magnet 12. The first element 10 in FIGS. 7, 8*a*, 8*b* and 8*c* may be combined with the second element 11 in FIG. 1. The first element 10 in FIGS. 8*a*, 8*b* and 8*c* may also be combined with the second element 11 in FIG. 9. The second element 11 in FIG. 9 is similar to that in FIG. 6*b*, and includes a protrusion 46 around the second ferromagnetic rod 30 that engages in the funnel-shaped recess 44. The tapers 19 and 42 and funnel-shaped portion 45 formed on the permanent magnet 12 according to the embodiments of FIGS. 7 and 8*a* and the embodiment of FIG. 1 may be replaced by rings 47, 48 made of any ferromagnetic materials such as iron, as shown in FIGS. 8*b* and 8*c*. In this case, a permanent magnet 12 of simple form may be employed.

According to the various embodiments of the present invention as described, a fastening operation can be completed simply by inserting the pointed lugs 39 of the metal disk plate 37 through the fastening member and engaging them with the curled edge. Thus, labor costs can be saved. In addition, any thickened portion may be appear on the fastening member due to the attachment is reduced considerably, and the appearance of the product is improved.

Although the present invention has been described by referring to specific embodiments and variations thereof, it should be understood that various changes and modifications may be made within the scope and spirit of the invention as defined in the appended claims.

What is claimed is:

1. A magnetic lock device comprising a first element to be attached to a first object, said first element including a permanent magnet and forming a magnetically attracting part, and a second element to be attached to a second object and forming a magnetically attracted part, said second element comprising:

a disk-shaped ferromagnetic plate having a first side to be directed toward said first element, a second side to be directed away from said first element, and a peripheral marginal edge;

a curled edge integral with said ferromagnetic plate and positioned radially laterally at said peripheral marginal edge thereof, said curled edge being arc-shaped in cross section and defining an opening that faces away from said second side of said ferromagnetic plate and said first element, said curled edge being formed on the outer periphery of a metal disk plate that is rigidly attached to said ferromagnetic plate centrally thereof; and an attaching device having extending therefrom pointed lugs shaped as saw teeth to be extended through the second object and through said opening and to be deformed along said curled edge, said attaching device comprising an annular, flat disk plate having a thickness to be accommodated within the thickness of the second object so as not to form a thickened portion bulging therefrom.

2. A magnetic lock device as claimed in claim 1, wherein said metal disk plate is positioned on said first side of said ferromagnetic plate.

3. A magnetic lock device as claimed in claim 1, wherein said metal disk plate is positioned on said second side of said ferromagnetic plate.

4. A magnetic lock device as claimed in claim 3, wherein said ferromagnetic plate includes a planar central portion, and an annular outer portion conically tapered in a direction toward said first element.

5. A magnetic lock device as claimed in claim 4, wherein said curled edge rests on said outer annular portion.

6. A magnetic lock device as claimed in claim 4, wherein said outer annular portion has therein an annular recess opening away from said first element, and said curled edge is positioned within said recess.

7. A magnetic lock device as claimed in claim 6, wherein said peripheral marginal edge of said ferromagnetic plate is positioned radially outwardly of said curled edge.

8. A magnetic lock device as claimed in claim 1, wherein said first element comprises another disk-shaped ferromagnetic plate having a first side to be directed toward said second element, said permanent magnet being positioned on said first side, a second side to be directed away from said second element, and a peripheral marginal edge, another curled edge integral with said another ferromagnetic plate and positioned radially laterally of said peripheral marginal edge thereof, said another curled edge being arc-shaped in cross section and defining an opening that faces away from said second side of said another ferromagnetic plate and said second element, and another attaching device having extending therefrom pointed lugs shaped as saw teeth to be extended through the first object and through said opening in and to be deformed along said another curled edge, said another attaching device comprising an annular, flat disk plate having a thickness to be accommodated within the thickness of the first object so as not to form a thickened portion bulging therefrom.

9. A magnetic lock device as claimed in claim 8, wherein said another curled edge is formed on the outer periphery of another metal disk plate that is rigidly attached to said another ferromagnetic plate centrally thereof.

10. A magnetic lock device as claimed in claim 9, wherein said another metal disk plate is positioned on said second side of said another ferromagnetic plate.

11. A magnetic lock device as claimed in claim 10, wherein said another ferromagnetic plate includes a planar central portion, and an annular outer portion conically tapered in a direction toward said second element.

12. A magnetic lock device as claimed in claim 11, wherein said another curled edge rests on said outer annular portion of said another ferromagnetic plate.

13. A magnetic lock device as claimed in claim 11, wherein said outer annular portion of said another ferromagnetic plate has therein another annular recess opening away from said second element, and said another curled edge is positioned within said another recess.

14. A magnetic lock device as claimed in claim 13, wherein said peripheral marginal edge of said another ferromagnetic plate is positioned radially outwardly of said another curled edge.

15. A magnetic lock device comprising a first element to be attached to a first object, said first element including a permanent magnet and forming a magnetically attracting part, and a second element to be attached to a second object and forming a magnetically attracted part, said first element comprising:

a disk-shaped ferromagnetic plate having a first side to be directed toward said second element, a second side to be directed away from said second element, and a peripheral marginal edge;

a curled edge integral with said ferromagnetic plate and positioned radially laterally at said peripheral marginal edge thereof, said curled edge being arc-shaped in cross section and defining an opening that faces away from said second side of said ferromagnetic plate and said second element, said curled edge being formed on the outer periphery of a metal disk plate that is rigidly attached to said ferromagnetic plate centrally thereof; and an attaching device having extending therefrom pointed lugs shaped as saw teeth to be extended through the first object and through said opening and to be deformed along said curled edge, said attaching device comprising an annular, flat disk plate having a thickness to be accommodated within the thickness of the first object so as not to form a thickened portion bulging therefrom.

16. A magnetic lock device as claimed in claim 15, wherein said metal disk plate is positioned on said second side of said ferromagnetic plate.

17. A magnetic lock device as claimed in claim 16, wherein said ferromagnetic plate includes a planar central portion, and an annular outer portion conically tapered in a direction toward said second element.

18. A magnetic lock device as claimed in claim 17, wherein said curled edge rests on said outer annular portion.

19. A magnetic lock device as claimed in claim 17, wherein said outer annular portion has therein an annular recess opening away from said second element, and said curled edge is positioned within said recess.

20. A magnetic lock device as claimed in claim 19, wherein said peripheral marginal edge of said ferromagnetic plate is positioned radially outwardly of said curled edge.

* * * * *